United States Patent [19]

Hettlage et al.

[11] Patent Number: 4,967,170

[45] Date of Patent: Oct. 30, 1990

[54] ROTARY WAVEGUIDE SWITCH HAVING ARCUATE WAVEGUIDES REALIZED BY PLANAR FACES

[75] Inventors: Eckart Hettlage, Karlsruhe; Gerd Ruff, Heidelberg, both of Fed. Rep. of Germany

[73] Assignee: Teldix GmbH, Heidelberg, Fed. Rep. of Germany

[21] Appl. No.: 254,931

[22] PCT Filed: Jan. 28, 1987

[86] PCT No.: PCT/EP87/00037

§ 371 Date: Aug. 8, 1988

§ 102(e) Date: Aug. 8, 1988

[87] PCT Pub. No.: WO87/04864

PCT Pub. Date: Aug. 13, 1987

[30] Foreign Application Priority Data

Feb. 8, 1986 [DE] Fed. Rep. of Germany ..... 3604077

[51] Int. Cl.[5] ..... H01P 1/10

[52] U.S. Cl. ..... 333/106; 333/108; 333/258

[58] Field of Search ..... 333/101, 106, 108, 258, 333/262; 335/4, 5

[56] References Cited

U.S. PATENT DOCUMENTS

| | | | |
|---|---|---|---|
| 2,769,144 | 10/1956 | Walters | 333/106 |
| 3,072,870 | 1/1963 | Walker et al. | 333/249 |
| 3,123,736 | 3/1964 | Christoffers et al. | 315/3.6 |
| 3,189,850 | 6/1965 | Walker et al. | 333/249 |
| 4,761,622 | 8/1988 | Cracknell et al. | 333/106 |
| 4,806,887 | 2/1989 | Au-Yeung | 333/106 |

FOREIGN PATENT DOCUMENTS

| | | | |
|---|---|---|---|
| 932436 | 2/1955 | Fed. Rep. of Germany . | |
| 65566 | 2/1956 | France . | |
| 66230 | 6/1956 | France . | |
| 2431197 | 2/1980 | France . | |
| 141003 | 8/1983 | Japan | 333/106 |
| 6706179 | 11/1968 | Netherlands . | |

OTHER PUBLICATIONS

Montgomery, C. G., et al., "Principles of Microwave Circuits"; Copyright 1948, McGraw Hill Book Co., Inc.; N.Y., U.S.A.; pp. 188–192.

*Primary Examiner*—Eugene R. LaRoche
*Assistant Examiner*—Benny Lee
*Attorney, Agent, or Firm*—Spencer & Frank

[57] ABSTRACT

A waveguide switch with four outputs or inputs (A, B, C, D) normally has one rotor (2) with three passages (3, 4, 5) with which, as appropriate, two waveguide connections can be effected in specific rotor positions. In two switching positions only the central waveguide passage (3) conducts HF signals, whereas in the two other switching positions both curved passages (4, 5) simultaneously conduct HF signals. Whereas the transmission losses in the central passage are low, a very high reflection level has hitherto been obtained in the two curved passages because of the points of inflexion. In order to improve the transmission characteristics, it is proposed to design the curved passages with an elliptical shape. For this, the longitudinal passage (3) is narrowed toward the central point of the rotor, so that sufficient space is provided for the curved portion of the lateral passages. The circular shape of the curved passages (4, 5) can also be approximated by a facet-like shaping of the sidewalls. The points of inflexion (8 or 9) thus created result in only insignificant changes in the transmission characteristics.

5 Claims, 2 Drawing Sheets

ROTARY WAVEGUIDE SWITCH HAVING ARCUATE WAVEGUIDES REALIZED BY PLANAR FACES

BACKGROUND OF THE INVENTION

The invention is based on a waveguide switch of the type including a housing having an axial bore and provided with at least four waveguide ports which each communicate with the bores have a rectangular cross section and which are all arranged in one plane transverse to the longitudinal axis of the bore and at right angles to one another, a cylindrical rotor disposed in the bore of the housing and provided with three waveguide passages having a corresponding rectangular cross section so as to produce different waveguide connections between the waveguide ports in certain rotor positions, with one of the waveguide passages being configured as a straight central passage and with the other of the waveguide passages being disposed on respectively opposite sides of the straight waveguide passage and each producing a deflection of the waveguide path by 90°.

Such a switch is known, for example, from DE-OS 3,441,728. In this prior art waveguide switch, the rotor is provided with three waveguide passages which are parallel to one another. Although the manufacture of such waveguide passages is rather simple, it has been found that, particularly at the junctions between rotor and stator, the bend in the waveguide path produces relatively high reflections. To improve transmission characteristics, it is advisable to give the two outer waveguide passages an arcuate shape (similarly to the configuration in DE-OS 2,924,969). However, the small dimensions of a miniaturized waveguide switch do not permit such an arcuate configuration.

SUMMARY OF THE INVENTION

According to the present invention, a waveguide switch of the above described type is modified in that: the straight central waveguide passage is given a cross-sectional taper toward the center of the rotor from each end; and the other waveguide passages each have an at least approximately arcuate shape with the respective faces of the longitudinally extending walls of the rotor which delimit these other waveguide passages each being formed of at least three planar face pieces with bends therebetween to approach the arcuate shape.

In contrast to the know waveguide switches of this general type, the waveguide switch according to the invention has the advantage that the taper in the longitudinal passage permits the other two waveguide passages to be given an arcuate shape, with the radius of the rotor remaining small, thus enabling the delimiting walls to be formed of planar face pieces which approach the arc. In this way, the reflection of the other two waveguide passages approaches that of the longitudinal passage.

In one embodiment of the invention, it is proposed to arrange the cross-sectional taper of the longitudinal passage in the manner of steps, similar to a $\lambda/4$ transformation, or to configure the cross-sectional taper of the waveguide without steps, which is more favorable for broadband transmission. Although the cross-sectional taper creates somewhat higher reflections in the longitudinal passage, such reflections are relatively slight; the important factor is the significantly improved transmission characteristic of the other two waveguide passages and that this is realized with a rotor diameter which remains small and thus permits small switch dimensions.

Forming the other waveguide passages by means of a plurality of planar face pieces provides, in addition to an improvement in transmission characteristics, also for simplification of the manufacture of the rotor.

Another feature of the invention is that so-called chokes are disposed on the rotor between the waveguide passages, in a known manner, to effect crosstalk attenuation between the individual signals to be transmitted.

Other advantages of the invention will become evident from the description and from the dependent claims The invention will now be described in greater detail with reference to one embodiment thereof

DETAILED DESCRIPTION OF THE PREFERRED EMBODIMENTS

Figure 1:
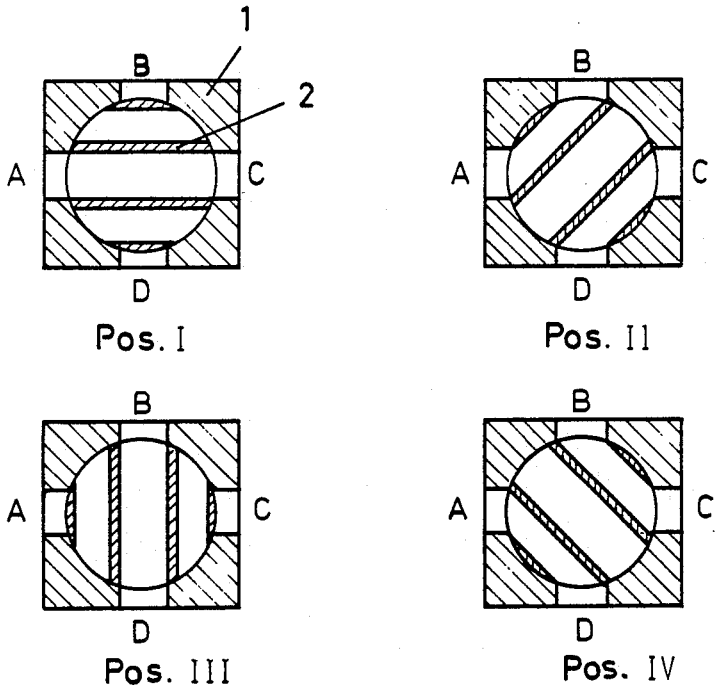
FIG. 1 (PRIOR ART)
FIG. 1 is a schematic cross-sectional representation of a prior art four-position switch (R switch) in its possible switch positions.

The prior art waveguide switch shown in FIG. 1 serves the purpose of connecting and separating various waveguide paths and is required, for example, to switch stand-by microwave devices into a system to replace a defective device if such a measure is necessary for reasons of operational safety. A necessity to provide stand-by units for safety reasons, where such stand-by units are put into operation when required by means of waveguide switches (ring redundancy) exists, in particular, in spacecraft.

The waveguide switch is composed of a housing 1 having four symmetrically arranged waveguide ports A to D. A rotor 2 disposed in the housing is arranged to be rotatable in the housing 1 and is provided with three waveguide passages disposed in a common plane. To enable the ports A-D to be combined in any desired manner, four switch positions I to IV are required, with position I connecting ports A-C, position II connecting ports A-B and C-D, position III connecting ports B-D and position IV connecting ports B-C and A-D with one another. With the cube-shaped configuration of switch housing 1, a plurality of switches can be coupled together in any desired manner so that any desired switch combinations can be realized.

Figure 2:
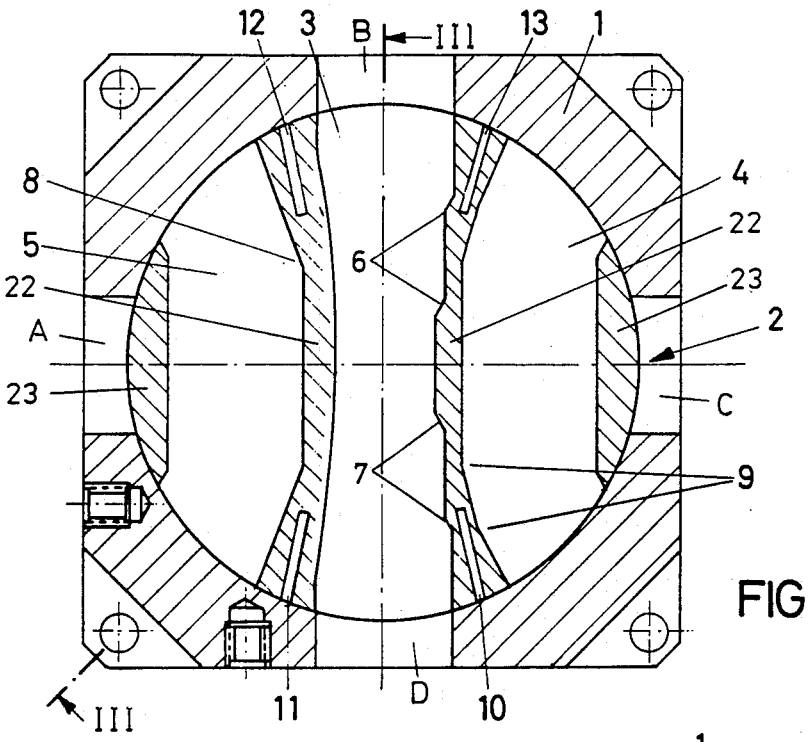
FIG. 2 is a cross-sectional view of a four-position waveguide switch of the type (R-switch)shown in FIG. 1 and showing the waveguide passages according to the invention.

To better illustrate the invention, the waveguide switch according to FIG. 2 is shown in a sectional view of the waveguide passages, with it being noted that this view shows a combination of several appropriate configurations of the waveguide passages which are possible within the scope of the invention.

Figure 3:
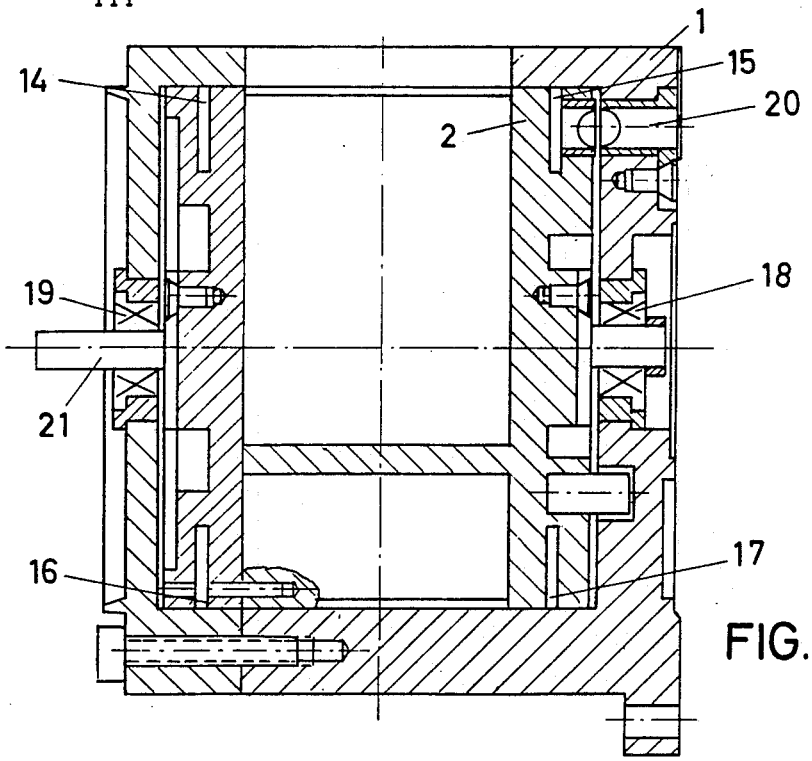
FIG. 3 is a sectional view of the switch shown in FIG. 2 in the direction III—III.

FIG. 3 is an axial sectional view of such a switch in the direction III—III of FIG. 2. As can be seen in FIG. 3, rotor 2 is fastened in housing 1 by means of bearings 18, 19. To set the switch positions, a motor or a setting member may be fastened to rotor shaft 21.

The exact rotor position is set by means of a position fixing element 20 (FIG. 3). This element is composed, for example, of two permanent magnets whose attraction forces hold the rotor in the switch positions. This of course requires a plurality of such permanent magnets on housing 1. As shown in FIG. 2 at the point of transition between rotor 2 and housing 1, i.e., at the circumference of rotor 2, longitudinal central passage 3 has a cross section which is identical to the cross section of the waveguide ports in housing 1. As shown on the right side or passage 3, this longitudinal passage 3 becomes narrower at two cross-sectional stepped tapers 6 and 7, respectively, until it reaches the middle of the rotor 2. Of course, only one or a greater number of such cross-sectional stepped tapers may be provided. Alternatively is is also possible to taper longitudinal passage 3 smoothly, i.e., without steps, as shown on the left inner surface in FIG. 3, on which side the longitudinal passage 3 has more favorable transmission characteristics for broadband transmission compared to the stepped taper.

The significant factor is that the cross-sectional taper of the longitudinal waveguide passage 3 provides space on the sides of the rotor 2 which can then be utilized to accommodate the delimiting walls 22 of the other two waveguide passages 4 and 5, which walls 22 are given the least possible thickness. In contrast to the further waveguide passages of FIG. 1, these other passages 4 and 5 can be configured, as shown in FIG. 2, in a shape approaching an arc and thus have a configuration which is more favorable with respect to reflections.

At its interior delimiting wall 22, further waveguide passage 4 is provided with four bends 9 and five planar face pieces or surfaces and with three planar surface pieces and two bends at its exterior delimiting wall 23. An alternative configuration is shown for further arcuate passage 5; this passage is provided with two bends 8 and three planar face pieces.

To attenuate crosstalk in the HF signals, so-called chokes 10, 11, 12, 13 in the form of slits are disposed between the waveguide passages as shown in FIG. 3. Further chokes 14, 15, 16, 17 are disposed in the jacket or circumferential surface of the rotor at the two end faces of the rotor 2 as shown in FIG. 3.

We claim:

1. In a waveguide switch including a housing having an axial bore and at least four waveguide ports extending to a circumference of said axial bore, each of said waveguide port having a rectangular cross section and being arranged in one plane transverse to a longitudinal axis of said bore and at right angles to one another in said plane, a cylindrical rotor disposed in said bore of said housing and provided with three waveguide passages having a corresponding, rectangular cross section so as to produce different waveguide connections between said waveguide ports in certain rotor potions, with one of said waveguide passages in the rotor being configured as a straight central passage and with the other two of said waveguide passages being disposed on respectively opposite sides of said one waveguide passage and with each of said other waveguide passages producing a deflection of the respective waveguide path by $\pi°$; the improvement wherein said one waveguide passage is given a cross-sectional taper toward the center of the rotor from each end of said one passage; and each of said other two of said waveguide passages has an at least approximately arcuate shape defined by respective faces of respective longitudinally extending walls of said rotor which delimit said other waveguide passages, each said wall being formed respectively of at least three planar face pieces with bends therebetween to approach said arcuate shape.

2. Waveguide switch according to claim 1, wherein said cross-sectional taper is step-shaped.

3. Waveguide switch according to claim 1, wherein said cross-sectional taper is smooth.

4. Waveguide switch according to claim 1, wherein said rotor includes a circumferential surface having portions which are located between said waveguide passages and which are provided with axially and radially oriented slits to provide cross-tack attentuation for high frequency signals.

5. Waveguide switch according to claim 1, wherein respective interior ones of said faces delimiting said other waveguide passages are each configured of five of said planar face pieces and the respective exterior ones of said faces delimiting said other waveguide passages are each configured of three of said planar face pieces.

* * * * *